United States Patent [19]

Anderson

[11] 4,085,477

[45] Apr. 25, 1978

[54] FLUE AND CHIMNEY CLEANERS

[76] Inventor: Charles H. Anderson, P.O. Box 54, Accord, N.Y. 12404

[21] Appl. No.: 796,606

[22] Filed: May 13, 1977

[51] Int. Cl.[2] ..... F23J 3/00

[52] U.S. Cl. ..... 15/243

[58] Field of Search ..... 15/104.18, 104.19, 162, 15/163, 165, 212, 242, 243, 246.5, 249; 166/174; 294/86.24, 97

[56] References Cited

U.S. PATENT DOCUMENTS

| | | | |
|---|---|---|---|
| 518,638 | 4/1894 | Weston | 15/104.18 |
| 1,315,849 | 9/1919 | MacDonald | 15/243 |
| 1,392,202 | 9/1921 | Nechville | 15/243 |
| 1,543,018 | 6/1925 | LeFeuvre | 15/243 |
| 1,582,309 | 4/1926 | Satterberg | 15/243 |

FOREIGN PATENT DOCUMENTS

| | | | |
|---|---|---|---|
| 1,006,779 | 1/1952 | France | 15/104.18 |

OTHER PUBLICATIONS

German Printed Application–Inventor Aden–Ser. No. K24557–Nov. 15, 1956.

*Primary Examiner*—Daniel Blum

*Attorney, Agent, or Firm*—Strauch, Nolan, Neale, Nies & Kurz

[57] ABSTRACT

A tool for cleaning flues or chimneys which has surface-engaging scrapers, levers for displacing the scrapers into engagement with the surfaces to be cleaned, and a resilient connector between the levers and an actuator therefor. The tool may be so made as to interchangeably accommodate scrapers of different sizes and shapes, and the blades may be made adjustable so that the same set of scrapers can be used in cleaning chimneys or flue surfaces of different dimensions.

6 Claims, 6 Drawing Figures

FIG. 1
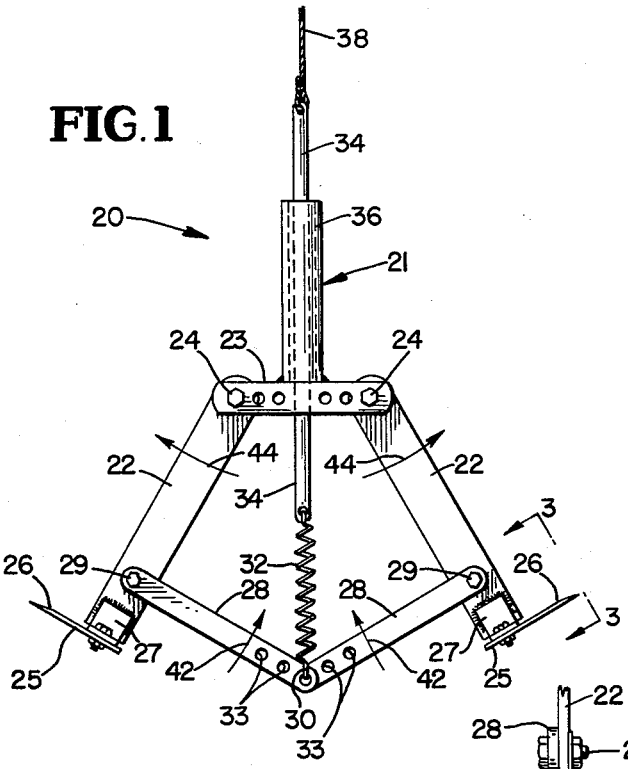
FIG. 2
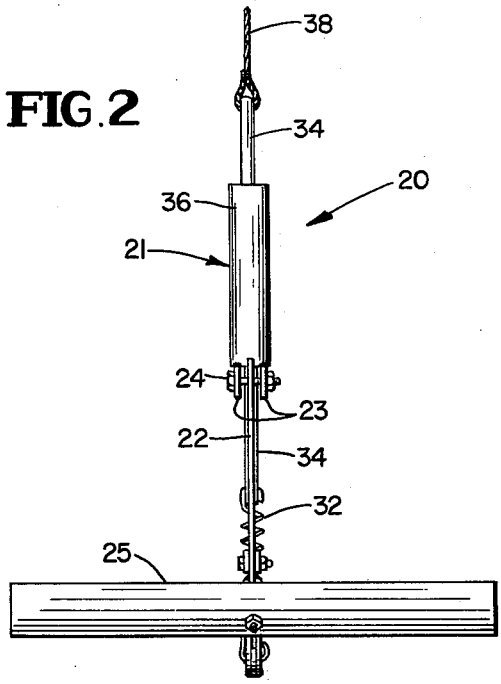
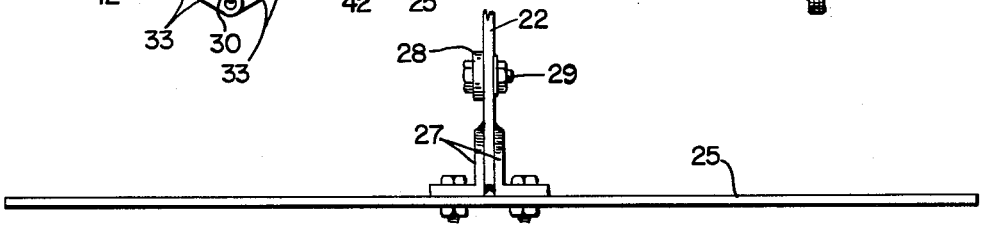
FIG. 3
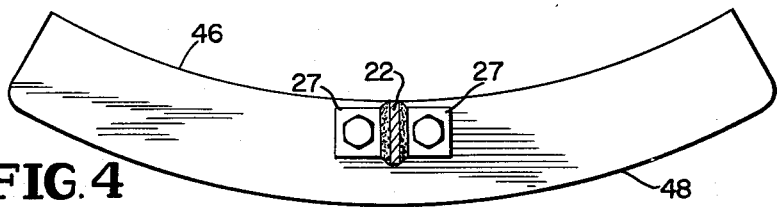
FIG. 4
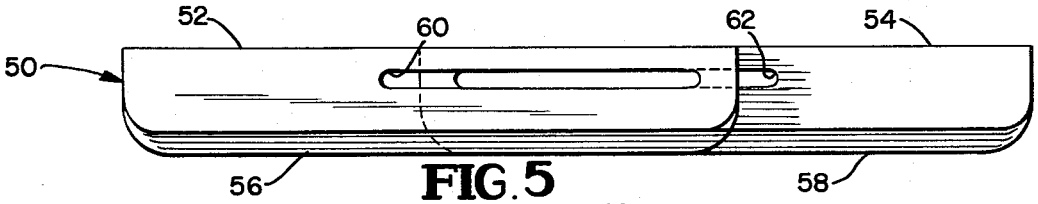
FIG. 5
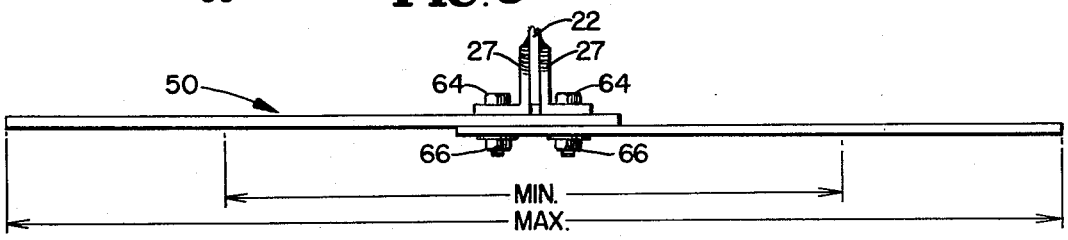
FIG. 6

FLUE AND CHIMNEY CLEANERS

This invention relates to cleaning tools and, more particularly, to tools for scraping deposits from chimneys, flues, and the like.

Tools of the class in question are disclosed in U.S. Pat. Nos. 1,392,202 issued Sept. 27, 1921, to Nechville; 1,398,155 issued Nov. 22, 1921, to Rork; 1,543,018 issued June 23, 1925, to Feuvre; 1,663,604 issued Mar. 27, 1928, to Moen; and 3,118,160 issued Jan. 21, 1964, to Maxia.

The most important and primary object of the present invention resides in the provision of novel, improved tools of the type in question and, more specifically, in the provision of such tools which have advantages not possessed by those disclosed in the above-listed patents.

The foregoing and other important objects of the invention are achieved by a novel construction which includes a support to which the upper ends of two scraper mounting arms are pivotally fixed. These arms are connected through pivotable levers and a spring type link to an actuator which is displaceable with respect to the support and is adapted to have a hoisting or supporting line fixed to its upper end.

A number of advantages result from this novel construction. It permits the tool to be raised and lowered in the structure being cleaned without the necessity of locking the scraper supporting arms together. At the same time, while an upward pull on the actuator is capable of forcing the scrapers into firm engagement with the surfaces being cleaned, the spring furnishes a resilient link which allows them to move inwardly to the extent necessary to clear protrusions and the like.

Yet another advantage of my novel construction is its combination of ruggedness and simplicity.

The primary object of my invention has been identified above. Other important objects and features and additional advantages of my invention will become apparent from the foregoing general description thereof and the appended claims and as the ensuing detailed description and discussion proceeds in conjunction with the accompanying drawing, in which:

FIG. 1 is an end view of a cleaning tool constructed in accord with and embodying the principles of the present invention;

FIG. 2 is a side view of the tool of FIG. 1;

FIG. 3 is a view of the tool 1 of FIG. 1, taken substantially along line 3—3 of the latter Figure;

FIG. 4 is a plan view of a scraper which can be used in a tool as shown in FIGS. 1–3 to clean circular or arcuate surfaces;

FIG. 5 is a view similar to FIG. 3 of another tool embodying the principles of the present invention and distinguished in that the length of the scraper blade can be adjusted to accommodate structures of different dimensions; and FIG. 6 is a plan view of the scraper blades employed in the tool of FIG. 5.

Referring now to the drawing, FIG. 1 depicts a flue or chimney cleaning tool 20 constructed in accord with and embodying the principles of the present invention.

The components of tool 20 include a T-shaped support 21 and depending arms 22 pivotally fixed between opposite ends of horizontal bars 23 of support 21 by bolts 24 extending through the upper ends of the arms. Oppositely facing scrapers 25 having continuous scraping edges 26 on their outer sides are bolted to brackets 27 at and fixed to lower ends of arms 22, and inwardly extending levers 28 are pivotally fixed to scraper-supporting arms 22 above the scrapers by bolts 29 through the outer ends of the levers.

Levers 28 are pivotally secured together at their inner ends by a hook or eye 30 on the lower end of a spring 32. A series of apertures 33 in each of the two levers 28 in which eye 30 can be inserted permits the distance between arms 22 to be varied to adapt tool 20 to structures of different dimensions.

The upper end of the spring is fixed to a rodlike actuator 34 supported for sliding rectilinear movement in the cylindrical, vertical stem 36 of support 21.

Tool 20 is adapted to be supported or suspended from a line 38 fixed to the upper end of actuator 34.

A cleaning operation can be initiated by lowering tool 20 through the flue or chimney to be cleaned as the illustrated arrangement permits the scrapers and arms 22 to pivotally collapse toward the center of the tool in the absence of an upward pull on line 38. This is advantageous because it permits the tool to be lowered through the structure being cleaned without the necessity of positively locking the legs together.

With tool 20 at the bottom or lower end of the flue or chimney and the line 38 extending upwardly therethrough, an upward force is exerted on the line. The upward force causes an upward relative movement of the inner ends of levers 28 with respect to support 21. The levers therefore rotate about pivot members 29 in the directions indicated by arrows 42, pivoting arms 22 outwardly as indicated by arrows 44 and forcing scrapers 25 against the surfaces being cleaned.

Spring 32 furnishes a resilient link between levers 28 and actuator 34. This permits arms 22 and scrapers 25 to move over obstructions rather than binding thereon as tool 20 is pulled upwardly through the structure being cleaned.

Also, because the spring biases the scrapers against the surfaces being cleaned only while a positive upward force is exerted on line 38, it becomes possible to repeat the scraping of surface areas as needed. All that is required is to relax the pressure on the line sufficiently to collapse the scrapers and allow the cleaner to drop through the structure being cleaned to a lower level.

The tool 20 illustrated in FIGS. 1–3 is designed for cleaning structures which a rectangular section and flat surfaces. The tool can be readily modified to make it capable of cleaning round or arcuate surfaces simply by replacing the straight scrapers 25 with the scrapers 46 shown in FIG. 4. These have an arcuate cutting edge 48.

Tool 20 can also be readily modified so that it can be used for cleaning surfaces of different widths. This is done by substituting for the scrapers 25 shown in FIGS. 1–3 the scrapers 50 shown in FIGS. 5 and 6.

Each scraper 50 is composed of two telescopable blades 52 and 54 having continuous scraping edges 56 and 58 and overlapping, elongated slots 60 and 62.

The bolts 64 by which the scrapers are attached to the flanges or brackets 27 at the lower ends of arms 22 extend through slots 60 and 62. The blades can therefore be slid to positions between or at the minimum and maximum positions indicated in FIG. 5 and the retainers 66 threaded onto the lower ends of the bolts then tightened to frictionally retain the blades in the positions to which they are adjusted.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A tool for cleaning chimneys, flues, and the like comprising: a support opposed depending arms pivotally fixed at their upper ends to opposite ends of said support; scrapers having outwardly facing scraping edges fixed to the lower ends of said arms; inwardly extending levers pivotally secured at their outer ends to the lower ends of said depending arms; an actuator rectilinearly displaceable relative to said support; and a spring fixed at one end to said actuator; the other end of said spring pivotally connecting together the inner ends of said levers, whereby rectilinear displacement of said actuator relative to said support will effect pivotal movement of said arms relative to said support with said spring providing a resilient connection therebetween to aid in the prevention of binding between the scrapers and a structure being cleaned.

2. A tool as defined in claim 1 in which said support has a tubular stem and said actuator is slidably supported in said stem.

3. A tool as defined in claim 1 in which said scrapers are oriented transversely of said arms and wherein said scrapers are adjustable in length in said transverse direction.

4. A tool as defined in claim 3 in which each of said scrapers is composed of a pair of blades, in which there are elongated slots in said blades, and in which the means for fixing said scrapers to said arms comprise threaded members fixed relative to said arms and relative to which said blades can be slid to vary the length of the scrapers and retainers threaded on said members for fixing said blades in the positions to which they are adjusted.

5. A tool as defined in claim 1 in which the scrapers have straight, continuous scraping edges.

6. A tool as defined in claim 1 in which the scrapers have arcuate, continuous scraping edges.

* * * * *